US006390789B1

(12) United States Patent
Grob et al.

(10) Patent No.: US 6,390,789 B1
(45) Date of Patent: May 21, 2002

(54) COOLING MEANS FOR THE MOTOR OF A TURBOCOMPRESSOR

(75) Inventors: Denis Grob; Jean Claude Pradetto; Dominique Dessibourg, all of Zürich (CH)

(73) Assignee: Sulzer Turbo AG, Zurich (CH)

( * ) Notice: Subject to any disclaimer, the term of this patent is extended or adjusted under 35 U.S.C. 154(b) by 0 days.

(21) Appl. No.: 09/599,098

(22) Filed: Jun. 20, 2000

(30) Foreign Application Priority Data

Jul. 16, 1999 (EP) ..... 99810640
Mar. 31, 2000 (EP) ..... 00810275

(51) Int. Cl.[7] ..... F04B 35/00; F04B 3/00; F04B 17/00; F04B 35/02

(52) U.S. Cl. ..... 417/350; 417/251; 417/366; 417/369; 417/360; 417/361; 417/372

(58) Field of Search ..... 417/251, 366, 417/369, 360, 361, 372, 350

(56) References Cited

U.S. PATENT DOCUMENTS 4,523,896 A 6/1985 Lhenry et al. ..... 417/350
4,969,803 A * 11/1990 Turanskyj ..... 417/350
6,196,809 B1 * 3/2001 Takahashi et al. ..... 417/360

FOREIGN PATENT DOCUMENTS

DE 3729486 C1 12/1988 ..... 417/350
EP 0087197 A1 8/1983 ..... 417/350
EP 0297691 A1 4/1989
WO WO 94/29597 12/1994
WO WO 95/24563 9/1995

OTHER PUBLICATIONS

Marriot, Andrew et al., "Un nouveau compresseur pour gazoducs–le Mopic", *Revue Technique Sulzer* vol. 73. No. 1, 1991, pp. 30–40.

* cited by examiner

*Primary Examiner*—Charles G. Freay
*Assistant Examiner*—Timothy P. Solak
(74) *Attorney, Agent, or Firm*—Townsend and Townsend and Crew LLP

(57) ABSTRACT

A turbocompressor (1) has an outwardly gas-tight housing (6) within which an electric motor (2) and a multistage radial turbocompressor (3) are arranged on a common shaft (13). For journalling the shaft (13), electromagnetic radial bearings (5) are arranged spaced apart in the direction of the shaft. A gas seal (19) surrounding the shaft (13) is arranged between the electric motor (2) and the radial turbocompressor (3) in order to seal off the electric motor (2) with respect to the radial turbocompressor (3). The electric motor (2) has an inner space (9*b*, 9*c*) which is connected in a fluid-conducting manner to an outlet opening (6*h*; 21) which passes through the housing.

9 Claims, 5 Drawing Sheets

COOLING MEANS FOR THE MOTOR OF A TURBOCOMPRESSOR

BACKGROUND OF THE INVENTION

The invention relates to a turbocompressor.

A turbocompressor is known which comprises a radial turbocompressor and an electric motor, with each of these units being arranged in a separate housing and with the shaft of the electric motor being coupled to the shaft of the radial turbocompressor via a flexible shaft part.

Disadvantageous in this known turbocompressor is the fact that the latter is designed to be rather large, that a plurality of seals and bearings is required and that the manufacturing costs of the turbocompressor are therefore relatively high.

The document DE 27 29 486 C1 discloses in FIG. 1*a* a turbocompressor which includes two two-stage radial turbocompressors and also an electric motor, with these being coupled to a rigid shaft which is journalled at three positions with magnetic radial bearings. This embodiment has the disadvantage that the assembly is very complicated and difficult, that this arrangement is suitable for an at most two-stage radial turbocompressor and that the turbocompressor has relatively high dissipation losses.

SUMMARY OF THE INVENTION

It is an object of the present invention to propose an economically more advantageous turbocompressor.

This object is attained with a turbocompressor comprising an electric motor, a multistage radial turbocompressor and also a common shaft, with a part section of the shaft being formed as the armature of the electric motor and wherein a further part section of the shaft is formed as the rotor of the radial turbocompressor, with the rotor including a compressor shaft and also compressor wheels connected therewith, wherein a plurality of magnetic radial bearings are arranged spaced apart in the direction of extent of the shaft for the journalling of the shaft, wherein a single electromagnetic radial bearing is arranged between the armature of the electric motor and the compressor wheel, and wherein the electric motor, the radial turbocompressor, the shaft and also the radial bearings are arranged in a common housing sealed in gas-tight manner relative to the outside. The housing consists of a plurality of part housings which can be fixedly connected together, the electric motor is arranged in one part housing and the radial turbocompressor in one part housing and the armature of the electric motor and also the rotor of the radial turbocompressor are connectable to form a common shaft via a coupling arranged between the armature of the electric motor and the compressor wheel.

The object is furthermore satisfied in particular by a turbocompressor comprising an electric motor, a multiple-stage radial turbocompressor and a common shaft, with a partial section of the shaft being designed as the armature of the electric motor, and with a further partial section of the shaft being designed as the rotor of the radial turbocompressor, with the latter rotor comprising a compressor shaft and compressor wheels or impellers which are connected thereto, and with a plurality of electromagnetic radial bearings being arranged with spacing in the longitudinal direction of the shaft, with the radial bearings being supported on a common base element.

The object is further satisfied by a turbocompressor comprising a housing which is gas-tight towards the outside and within which an electric motor and also a multistage radial turbocompressor are arranged on a common shaft, wherein, for the journalling of the shaft, electromagnetic radial bearings are arranged spaced apart in its direction of extent and wherein a dry gas seal surrounding the shaft is provided between the electric motor and the radial turbocompressor in order to seal off the electric motor relative to the radial turbocompressor, with the electric motor having an inner space which is connected in fluid-conducting manner with an outlet opening which passes through the housing.

FIG. 1 shows a known turbocompressor which comprises an electric motor which is journalled at both ends and a radial turbocompressor which is journalled at both ends, with the shaft of the electric motor being coupled via a flexible shaft part to the shaft of the radial turbocompressor.

An advantage of the turbocompressor mi accordance with the invention is to be seen in that for the complete journalling of the entire shaft, in comparison with the exemplary embodiment in accordance with FIG. 1, three radial bearings, preferably designed as electromagnetic radial bearings, suffice in that a single radial bearing is arranged between the electric motor and the compressor. The turbocompressor can thus be manufactured economically.

The entire shaft can be designed as a single piece. In an advantageous embodiment the shaft of the electric motor as well as the shaft of the radial turbocompressor are connected via a coupling, in particular a coupling with as high a stiffness as possible. A very stiff coupling permits the design of a total shaft which has a largely homogeneous stiffness in the longitudinal direction of the shaft. The entire shaft or, respectively, the entire rotatable components of the turbocompressor behave thereby like a compact shaft, which has a positive effect on a stable running behavior of the turbocompressor. In addition this enables the entire shaft to be journalled in the axial direction with the help of a single axial bearing. In the embodiment known from FIG. 1 a separate axial bearing each is required for the electric motor and the radial turbocompressor.

If a radial turbocompressor is arranged only at one side of the electric motor, then three radial bearings which are arranged to be spaced in the longitudinal direction of the shaft suffice for the complete journalling of the entire shaft. If a radial turbocompressor is, arranged at each side of the electric motor, then four electromagnetic radial bearings which are arranged to be spaced in the longitudinal direction of the shaft suffice for the complete journalling of the entire shaft.

Dispensing with a radial bearing between the electric motor and the radial turbocompressor has in addition the advantage that the entire shaft can be shorter, which is rotor-dynamically advantageous, enables the forming of a lighter shaft, and yields a more compact construction of the turbocompressor in addition. In this it should be considered that electromagnetic radial bearings have a substantially lower bearing load in comparison with hydrodynamic radial bearings, which results in a more advantageous dynamic behavior of the rotor because of the shorter shaft as well as the lower weight, which are of decisive importance in order to operate the turbocompressor reliably and without disturbance by means of electromagnetic bearings. This aspect is in particular of importance for radial turbocompressors which compress a fluid to a high pressure of for example 600 bar. When such a highly compressed fluid encounters a flow disturbance, relatively large radial and axial forces are generated which can be absorbed by the electromagnetic bearing, which has only a limited load capacity, only when the dynamic behavior of the rotor of the entire system is optimized.

In a particularly advantageous embodiment the motor and the radial turbocompressor are arranged in a common, hermetically sealed-off housing, in particular in a pressure housing, with a fluid-conducting input and output line passing through the housing or being fanged onto the housing in order to conduct in and out the fluid to be compressed. This arrangement has the decisive advantage that no seals against the outside, in particular against the atmosphere, are required at the shaft, which in addition to the cost advantage yields the further advantages that periods of disuse which are caused by sealing problems no longer arise, and that the total length of the shaft can additionally be reduced, which again increases the total weight of the shaft and the stability of the shaft which is held by electromagnetic bearings.

The radial turbocompressor with a pressure housing which is hermetically sealed off against the outside also permits the motor-compressor plant in accordance with the invention to be operated at sites which were previously unsuitable for the operation of a radial turbocompressor, for example under water or in an environment with high pollutant content, a high degree of contamination or a high risk of explosion.

A further advantage of the turbocompressor in accordance with the invention is to be seen in that the latter can also be operated very reliably by remote control. The turbocompressor has for example no elaborate oil system for journalling the armature. In addition no or only few seals are required. The turbocompressor therefore has no components, for the operation of which an expert is required on site, or components which require a regular checking at relatively short time intervals. A start and stop process of the turbocompressor can be run by remote control, with it being possible to remotely monitor the states of the turbocompressor by means of sensors; and suitable measures, for example a stopping, can automatically be initiated when an irregularity is detected. A turbocompressor in the embodiment with a hermetically sealed-off pressure housing has the further advantage that the risk of disturbing influences acting from the outside is very low.

In order to compress the fluid to a high final pressure it was previously required to provide the turbocompressor with very expensive dry gas seals, with these dry gas seals having in addition to the high price the further disadvantage that they require a considerable maintenance and in addition represent a risk component, considering that most of the unpredictable periods of disuse of a turbocompressor are caused by damages to the dry gas seal.

In a further advantageous embodiment a portion of the compressed fluid or process gas respectively is used for the longitudinal gas cooling of the motor and the radial bearings. This is in particular advantageous in the use of a common, hermetically sealed-off pressure housing. A motor which is designed for suction pressure or standstill pressure is preferably used in this as the electric motor. In a further advantageous embodiment the electric motor has its own coolant circuit, which is separate from the radial turbocompressor.

In an advantageous embodiment of the turbocompressor in accordance with the invention the latter has a common base element which is for example designed in the shape of a plate and on which some, preferably all, radial bearings are supported. The arrangement of the radial bearings on a common base element has the advantage that the former are oriented in a definite position with respect to one another, and that the mutual displacements of the radial bearings which are caused by tension, compression or shear stresses or by temperature influences respectively can be kept to a minimum. A mutually precisely arranged orientation of the radial bearings is thus ensured at the most varied operating conditions. Advantageously, not only the radial bearings, but also the other elements, such as the electric motor, the radial turbocompressor, etc., are arranged on the base element. This enables an assembly of the turbocompressor as a finished total module at the manufacturing plant, also thanks not least to the compact construction of the turbocompressor in accordance with the invention. This module can be put into operation at the site of the application very rapidly since it is no longer necessary to precisely anchor the radial turbocompressor and the electric motor separately to a base and in so doing to set their mutual position precisely. In an advantageous embodiment the turbocompressor is arranged inside a housing, with a part of the housing, for example the inner wall of the housing which is arranged below, also forming the common base element at the same time.

In an advantageous embodiment of the turbocompressor the radial turbocompressor and the motor are arranged in a common housing, with the housing consisting of a plurality of partial housings which can be connected to one another, or of a substantially single housing. Advantageously, the entire drive apparatus is arranged in one partial housing and the entire radial turbocompressor in a further partial housing, with these partial housings preferably being designed to be mutually matched in such a manner that they can be directly centered and mutually firmly connected. In an advantageous embodiment the common housing is stiffly designed such that the entire turbocompressor, comprising the radial turbocompressor, the motor, etc., is mutually journalled substantially without displacement by the common housing so that the common housing, for example, is designed as a tube without external support or is designed to be supportable with only one to two supports on a base. This arrangement has the advantage that the possibility of stationary and/or non-stationary displacements of the bearing locations are to the greatest extent prevented, for which reason a setting of the bearings on site is omitted, so that the manufacture and the putting into operation of the turbocompressor takes place more economically. If in the common housing a slight dislocation of the individual shafts or, respectively, of the statically arranged parts of the motor or of the radial turbocompressor should nevertheless take place in the common housing, then there is also the possibility of compensating this deviation thanks to the use of electromagnetic radial bearings.

The known turbocompressor shown in FIG. 1 consists of a separate motor with its own housing and of a radial turbocompressor with a further, own housing. In this known arrangement the mutual movement of the housings or, respectively, the displacement of the individual shafts represents a considerable problem, which is caused by each housing being individually anchored at the base. Through different thermal expansions or other forces acting on the individual housings their position is changed. The arrangement in accordance with the invention of a motor and a radial turbocompressor on a common base element, in particular in a common housing, has the advantage that the base element or the housing respectively forms the reference for the journalling and therefore a mutual variation of the position of motor and radial turbocompressor is largely excluded.

The turbocompressor comprising a plurality of part housings has the advantages:

that the assembly of the full turbocompressor is very simple, that one rotatable unit which can be separately balanced and weighted is arranged in each part housing, that each part housing with the rotatable unit located therein can also be obtained from different suppliers; especially the electric motor and the radial turbocompressor can be obtained from different suppliers, that the maintenance of the turbocompressor is simpler and more cost-favorable.

DESCRIPTION OF THE PREFERRED EMBODIMENTS

Figure 1:
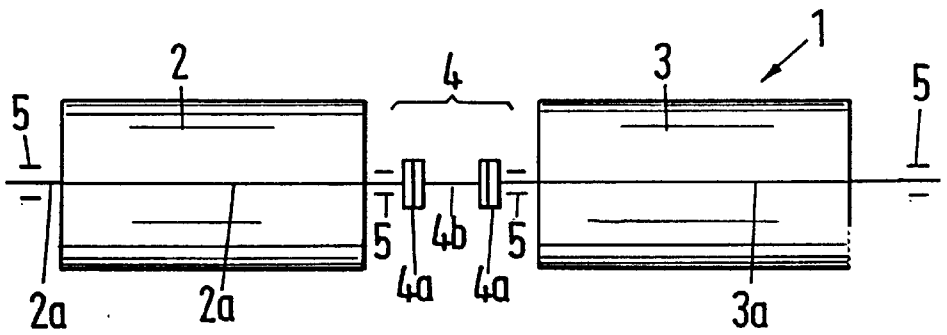
Fig.1 (PRIOR ART)
FIG. 1 schematically shows a known turbocompressor.

FIG. 1 shows schematically a known turbocompressor 1, which comprises a radial turbocompressor 3 with a shaft 3*a* and a driving electric motor 2 with a shaft 2*a*. The shaft 3*a* of the radial turbocompressor 3 is journalled at both ends by two radial bearings 5. The shaft 2*a* of the electric motor 2 is likewise journalled at both ends by two radial bearings 5 each. The two shafts 2*a*, 3*a* are connected via a coupling 4 comprising two coupling parts 4*a* and a flexible intermediate piece 4*b* so that the electric motor 2 drives the shaft 3*a* of the radial turbocompressor 3 via the shaft 2*a* and the coupling 4.

Figure 2:
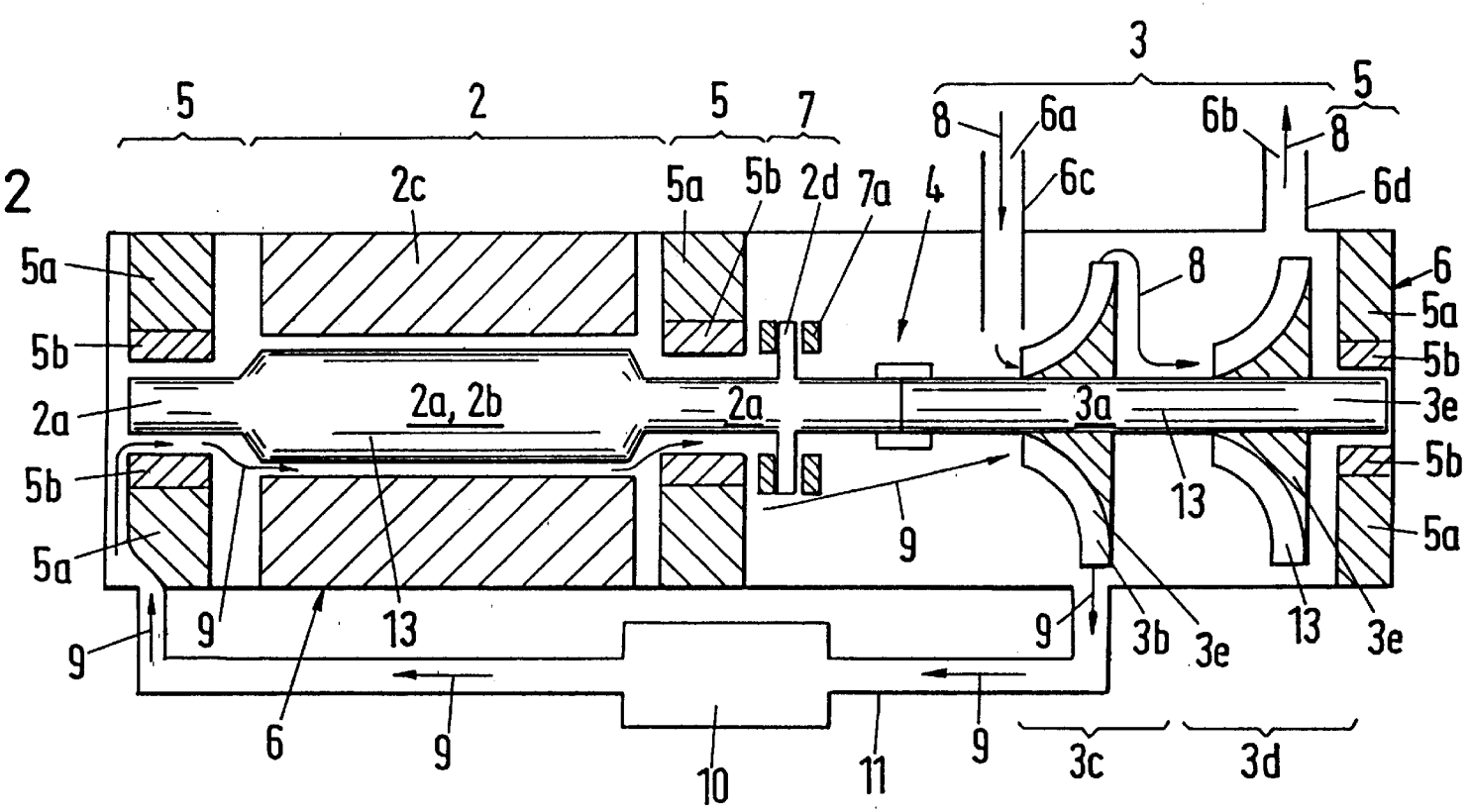
FIG. 2 is a longitudinal section of a turbocompressor with an electric motor and a radial turbocompressor.

FIG. 2 shows a turbocompressor 1 which is arranged in a hermetically sealed-off pressure housing 6, with one inlet line 6*c* and outlet line 6*d* each passing through the pressure housing 6, being provided in order to connect the radial turbocompressor 3 in a fluid-conducting manner to an apparatus which is arranged outside the pressure housing 6. The electric motor 2 comprises the armature 2*b* and the stator 2*c*, with the armature 2*b* being part of the motor shaft 2*a* and with the motor shaft 2*a* being journalled in the radial direction at both ends in the electromagnetic radial bearings 5, each of which comprises a support device 5*a* and an electromagnetic coil 5*b*. The motor shaft 2*a* has towards the radial turbocompressor 3 an axial bearing 7 which comprises a part of a disc 2*d* forming part of the motor shaft 2*a* and electromagnetic coils 7*a*. The motor shaft 2*a* is connected at its end section via a coupling 4 to the rotor 3*a* of the radial turbocompressor 3, with the oppositely lying end section of the rotor 3*a* being journalled in a radial bearing 5. The motor shaft 2*a* and the rotor 3*a* form a common shaft 13. In the longitudinal direction of the rotor 3*a* two impellers 3*b* are arranged which form a first compressor stage 3*c* and a second compressor stage 3*d*. Not illustrated are the guide vanes 3*f* of the radial turbocompressor 3. The main mass flow 8 of the fluid to be compressed, preferably in the form of a gas, enters via the entry opening 6*a* and the infeed line 6*c* into the first compressor stage 3*c* and is then conducted to the second compressor stage 3*d* and then via the outlet line 6*d* to the outlet opening 6*b*. A small fraction of the main mass flow 8 is diverted at the outlet of the first compressor stage 3*c* via a connection line 11 and is bypassed as a coolant gas mass flow 9 to a filter apparatus 10 which cleanses the coolant gas mass flow 9 of contaminations and feeds in the purified coolant gas mass flow 9 as a coolant to the electromagnetic radial bearings 5 and to the electric motor 2. In the illustrated exemplary embodiment the coolant gas mass flow 9 is fed in to the radial bearing 5 flowing in the longitudinal direction of the housing and then to the electric motor 2 as well as to the further radial bearing 5, with the coolant gas preferably being conducted between the shaft 2*a* and the respective magnet 5*b*, 2*c*. The coolant gas mass flow 9 opens to the suck-in side of the first compressor stage 3*c*, is in turn compressed by the latter and is forwarded on as main mass flow 8 and/or as coolant gas mass flow 9. The connection line 11 and the filter apparatus 10 can be arranged to pass inside or outside the pressure housing 6. The turbocompressor 1 in accordance with the embodiment which is illustrated in FIG. 2 has the advantage that no sealing of the motor shaft 2*a* or, respectively, of the rotor 3*a* against the atmosphere is required. In addition no seal between the motor 2 and the first compressor stage 3*c* is required. In this the electric motor 2 is to be designed in such a manner that the latter can be operated with suction pressure or with standstill pressure.

The turbocompressor 1 could naturally have a plurality of impellers 3*b* which are arranged with spacing in the longitudinal direction of the rotor 3*a*, thus for example a total of four, six, eight or ten impellers 3*b*. The compressor pressure which can be achieved is largely open upwardly, with it being possible to achieve for example a compression pressure of 600 bar trough a corresponding number of impellers 3*b* which are connected in series. The turbocompressor 1 could also comprise one or more further radial turbocompressors 3 and/or electric motors 2 which are arranged in the longitudinal direction of the rotor 2*b*;3*a*, with all rotors 3*a*; 2*b* forming a common shaft. This common shaft could be journalled by radial bearings, in particular magnetic radial bearings 5, with a single radial bearing 5 preferably being arranged between each one radial turbocompressor 3. All radial turbocompressors 3 are preferably arranged together with the electric motor 2 or the electric motors 2 in a single common pressure housing 6.

The electromagnetic radial bearings 5 and the sections of the shafts 2*a* and 3*a* which are associated with the radial bearings 5 have further components for the design of an electromagnetic radial bearing 5, which are self-evident for an expert and are therefore not illustrated, such as electric coils, ferromagnetic parts, etc. The same holds for the electric motor 2, which is likewise only schematically illustrated.

Figure 3:
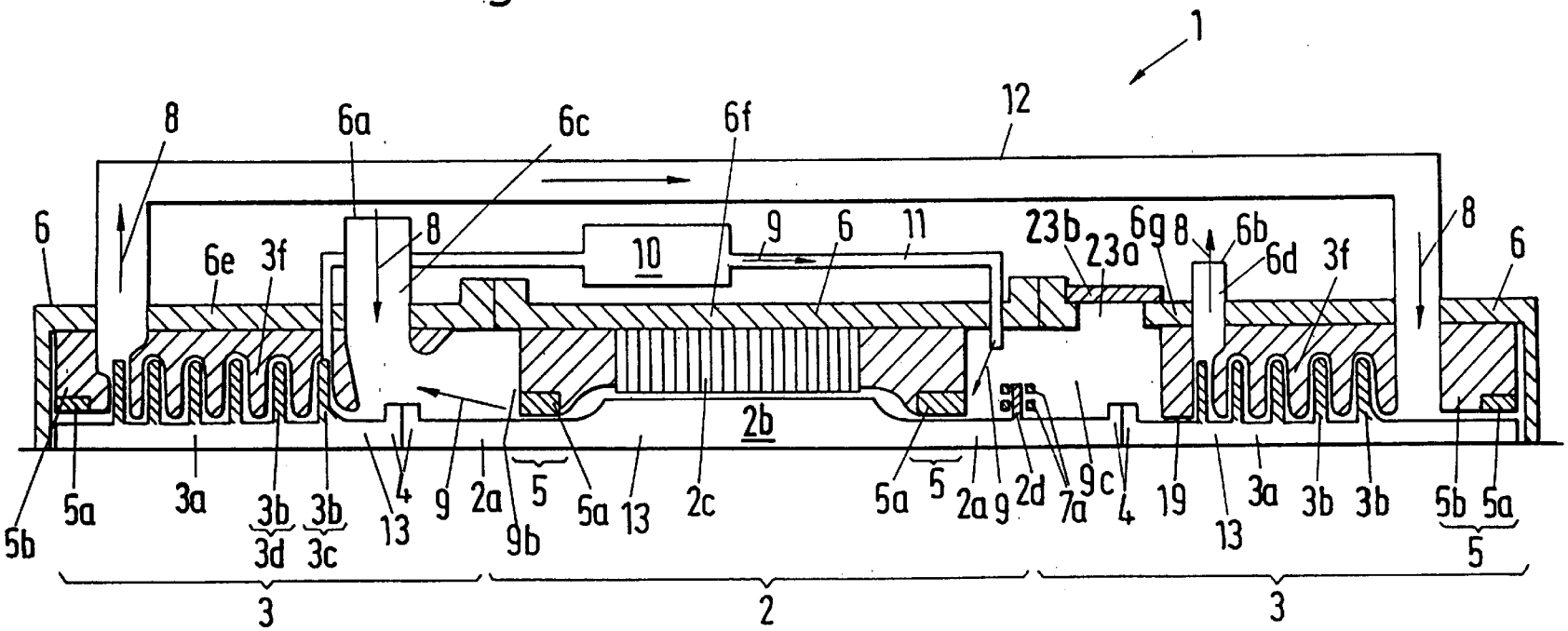
FIG. 3 is a longitudinal section of a turbocompressor with radial turbocompressors arranged at both sides.

FIG. 3 shows a longitudinal section of a further exemplary embodiment of a turbocompressor 1 comprising two radial turbocompressors 3, wherein at each side of the electric motor 2 one respective radial turbocompressor 3 is arranged, the rotor 3*a* of which is connected via a coupling 4 to the motor shaft 2*a*. Only the upper half of the turbocompressor 1 is illustrated. Only the essential differences with respect to the embodiment in accordance with FIG. 2 will be described in detail. The entire shaft, comprising the motor shaft 2*a* and the two rotors 3*a*, is journalled by four electromagnetic radial bearings 5 which are distributed in the longitudinal direction of the entire shaft. The radial turbocompressor 3 arranged on the left forms a low pressure part and has six impellers 3*b*. The radial turbocompressor 3 arranged on the right forms a high pressure part and has five impellers 3*b*. Likewise illustrated are the guide vanes 3*f*. The main mass flow 8 enters via the infeed line 6*c* into the low pressure part and is fed to the high pressure part after the compressing via a connection line 12, with the main mass flow 8 leaving the high pressure part after the compressing via the outlet line 6*d*. A small portion of the main mass flow 8 is conducted after the first compressor stage 3*c* as coolant gas mass flow 9 into the connection line 11. After flowing through filter 10, the coolant gas mass flow 9 flows to the inner space 9*c* arranged at the right side of the electric motor 2, and then, flowing in the longitudinal direction of the motor shaft 2*a*, it flows via the inner space 9*b* to the suction opening of the first compressor stage 3*c*. Thus a portion of the process gas which is located in the radial turbocompressor 3 is conducted off to and used for the cooling of the electric motor 2.

A contactless seal 19 is arranged at the rotor 3*a* between the radial turbocompressor 3 which is arranged at the right and the electric motor 2 in order to keep the inner pressure at the right side of the electric motor 2 correspondingly low. The electric motor 2 in turn operates at a suction pressure or a standstill pressure. The connection line 12 and/or the connection line 11 as well as the filter apparatus 10 could be arranged to extend completely inside the housing 6.

The radial turbocompressors 3 can also for example be arranged in a "back to back" arrangement, in other words such that the forces which act on the shaft due to the two radial turbocompressors 3 act in the opposite direction in order in this way to compensate and reduce the thrust forces which act in the longitudinal direction of the motor shaft 2*a*.

Figure 4:
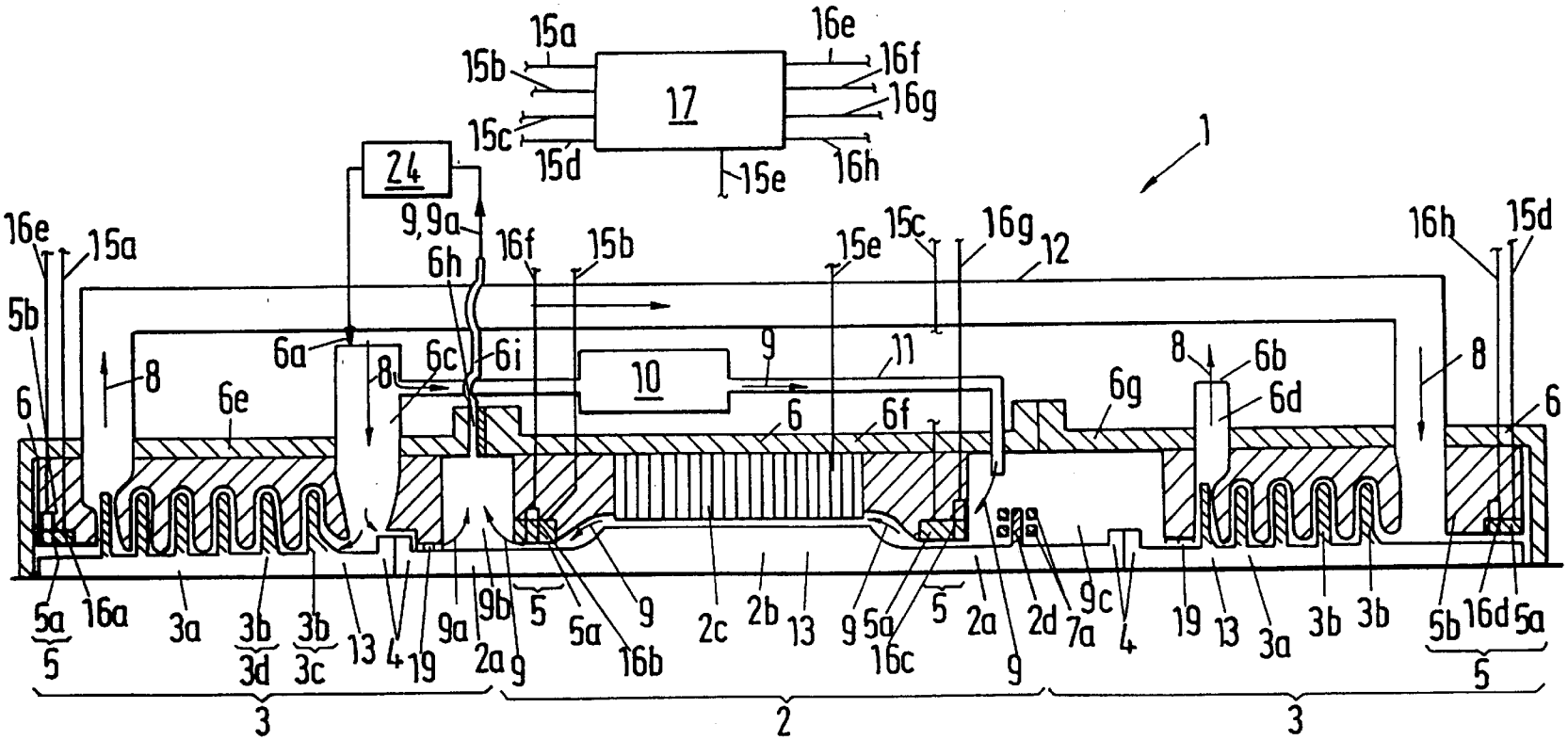
FIG. 4 is a further longitudinal section of a turbocompressor with radial turbocompressors arranged at both sides.

The housing 6 is composed in the embodiments in accordance with FIGS. 3 and 4 of the three partial housings 6*e*, 6*f*, 6*g*, with the partial housings 6*e*, 6*g* forming part of the radial turbocompressor 3 and the partial housing 6*f* forming part of the electric motor 2. The partial housings 6*e*, 6*f*, 6*g* are designed to be mutually matched in such a manner that they can be firmly connected to one another, for example by means of screws, as illustrated in FIGS. 3 and 4. Seals can also be arranged at these joints in order to hermetically seal off the inner space of the housing 6 so that a fluid-conducting connection between the inner space of the housing 6 and the ambient exists only via the provided lines 6*c*, 6*d*, 11, 12, or via corresponding flanges, with a fluid-conducting connection to the ambient existing only through the lines 6*c*, 6*d* and where appropriate through the outlet line 6*i* as a result of the arrangement of the lines 11 and 12 illustrated in FIGS. 3 and 4. The connection points could moreover be so mutually adapted and designed that adjacently disposed part housings are automatically mutually centered with respect to the longitudinal axis of the turbocompressor 1 on being pushed together and connected. The two part housings 6*e*, 6*g* each have an opening 23*a* in the outer wall which can be closed in gas-tight manner by a cover 23*b*. In FIG. 3 the opening 23*a* arranged in the part housing 6*g* is shown with the cover 23*b*. The turbocompressor 1 is preferably pre-manufactured in such a way that the radial turbocompressor 3 is built into the respective part housing 6*e*, 6*g* and the electric motor 2 is built into the part housing 6*f*. The part housings 6*e*, 6*f*, 6*g* which have been pre-configured in this way are transported in the assembled state to the place of use. The assembly of a turbocompressor 1 is as follows: After the part housings 6*e*, 6*f*, 6*g* have been firmly connected to one another via the flanges 6*k*, 6*l*, the shaft 3*a* and the rotor 2*b* are firmly connected together at the coupling 4 which is accessible from the outside through the opening 23*a*. Thereafter, the opening 23*a* is closed fire and in gas-tight manner with the cover 23*b*. The fastening means used at the coupling 4, such as for example bolts, are known per se and thus not shown in detail.

The turbocompressor 1 illustrated in FIG. 4, which is otherwise designed substantial the same as the turbocompressor in accordance with FIG. 3 has, in the housing part 6*e*, an outlet opening 6*h* connected in fluid-conducting manner to the inner space 9*b* and an output line 6*i* which is arranged following the latter and through which the coolant gas mass flow 9 and a small proportion of the main mass flow 9*a* emerges and is, for example, conducted to a process source which is external to the plant. This arrangement has the advantage, in contrast to the exemplary embodiment in accordance with FIG. 3, that the pressure in the apparatus which follows the output line 6*i* is independent of the pressure in the radial turbocompressor 3, with this pressure preferably being chosen in such a manner that the motor cooling takes place at a lower pressure level than in the embodiment in accordance with FIG. 3, which has the advantage that the dissipation losses in the motor 2 which arise between the rotating and the static parts are reduced. A seal 19 is arranged at each side between the motor 2 and the radial turbocompressor 3. The output line 6*i* can for example be supplied to a compressor 24 which supplies the mass flow 9, 9*a*, compressed again to the inlet opening 6*a*. The suction pressure produced by the compressor in the output line 6*i* can for example be lower than 50 bar.

In addition a regulation apparatus 17 is illustrated in FIG. 4 which serves at least for the control of the electromagnetic radial bearings 5 and of the motor 2. Sensors 16*a*, 16*b*, 16*c*, 16*d* which measure the position of the entire shaft 13 or, respectively, of the partial shafts 2*a*, 3*a* relative to the radial bearings 5 are arranged in the region of the radial bearings 5, with the sensors 16*a*, 16*b*, 16*c*, 16*d* being connected via electric lines 16*e*, 16*f*, 16*g*, 16*h* to the regulation apparatus 17. Electric lines 15*a*, 15*b*, 15*c*, 15*d* which are connected to the regulation apparatus 17 are provided for controlling the magnetic coils of the radial bearings 5. In addition an electric line 15*e* is provided which connects the regulation apparatus 17 to the winding of the electric motor 2 via a non-illustrated power electronic circuitry.

Figure 5:
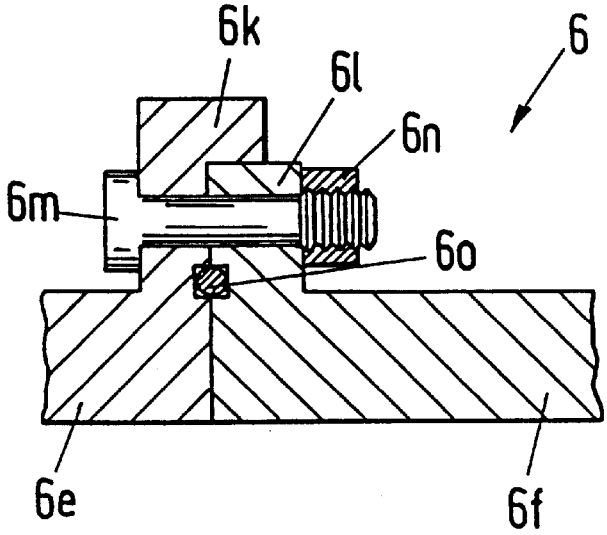
FIG. 5 is a longitudinal section through the joint of two partial housings.

FIG. 5 shows a longitudinal section through a housing 6, with the joint of two partial housings 6*e*, 6*f* being illustrated. The flange 6*k* of the first partial housing 6*e* has a recess which is designed in such a manner that the flange 61 of the second partial housing 6*f* finds an accommodation therein, with the mutual position of the two partial housings 6*e*, 6*f* being mutually centered by the flanges 6*k*, 6*l* during the fitting together. The flanges 6*k*, 6*l* are held together by a plurality of screws 6*m* with nuts 6*n* which are distributed in the circumferential direction, with a groove being provided at the end side of the flanges 6*k*, 6*l* which extends in the circumferential direction and in which a sealing element 6*o* is arranged in order to seal off the inner space which is bounded by the two partial housings 6*e*, 6*f* against the outside.

Figure 6:
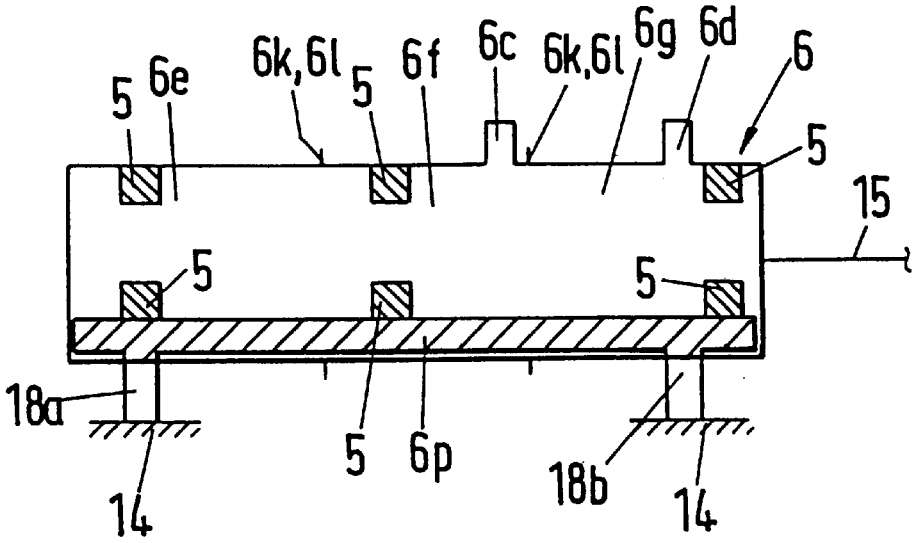
FIG. 6 is a longitudinal section of a schematically illustrated housing consisting of three partial housings.

FIG. 6 shows a longitudinal section of a schematically illustrated housing 6 consisting of three partial housings 6*e*, 6*f*, 6*g* with flanges 6*k*, 6*l* as well as an input line 6*c* and an output line 6*d*. The housing 6 is supported via two support elements 18*a*, 18*b* on a base 14. Inside the housing a base element 6*p* is arranged which forms a stiff support, in particular a support surface, which extends in the longitudinal direction of the housing 6 and on which the electrical radial bearings 5 are arranged. The function of the base element 6*p* is to form as stable and preferably temperature-insensitive a reference plane as possible on which at least some radial bearings 5 are arranged. The base element 6*p* can be designed in a plurality of embodiments, thus for example as a fixed, solid plate, as a carrier or as a grate.

Further components such as the electric motor 2 or the radial turbocompressor 3 can be anchored on the base element 6*p*. The use of a base element 6*p* enables the electromagnetic radial bearings 5 to be mutually arranged very precisely and in particular exactly aligned to each other. The common arrangement of the radial bearings 5 on the base element 6*p* has the advantage that the mutual displacements of the radial bearings which are caused by reason of acting tension, compression or shear forces or through temperature influences remain small. In addition this arrangement can be set up so as to be ready for operation very rapidly. In the arrangement which is known from FIG. 1 it was necessary to set up the two separate apparatuses electric motor 2 and radial turbocompressor 3 separately and to align them very precisely in a time-consuming procedure in order that the shafts 2*a*, 3*a* are arranged to be aligned. In spite of this effort the electric motor 2 and/or the radial turbocompressor 3 or, respectively, their radial bearings 5 can become mutually displaced, caused for example by acting forces, a displacement of the foundation or changes in temperature.

The bearing force which can be produced by electromagnetic radial bearings is substantially lower than the bearing force which can be produced by known, hydrodynamic bearings. Therefore, the precise mutual alignment of the electromagnetic radial bearings and the prevention of a mutual displacement of the radial bearings is of central importance. The electromagnetic radial bearing is usually operated in such a manner that the shaft is held at the geometrical center of the radial bearing. A mutual displacement of the radial bearings has the result that the radial bearing must exert a considerable force in order nevertheless to hold the shaft at the geometrical center. Since the electromagnetic radial bearing relatively soon arrives at the state of a magnetic saturation, the radial bearing in this situation provides a lower load available,for bearing the shaft. This effect reduces the operating safety of the turbocompressor, with the electromagnetic radial bearing no longer being able to carry the shaft in the extreme case. Therefore, it is of central importance when using electromagnetic radial bearings that the latter are arranged to be aligned as precisely as possible, and that they are arranged in such a manner that a mutual displacement of the radial bearings is also prevented as far as possible during the operation of the turbocompressor. Therefore it is also advantageous when the electromagnetic radial bearings have a greater mutual distance in the longitudinal direction of the common shaft 13. In the known embodiment in accordance with FIG. 1 the two radial bearings 5 in the middle have a relatively low mutual distance so that in the event of a mutual displacement of these two radial bearings 5 in the middle the problem can arise that the latter produce forces which act counter to one another in the radial direction, which has the effect that the load of the electromagnetic radial bearing which remains available for bearing is lower or is even no longer available.

Figure 7:
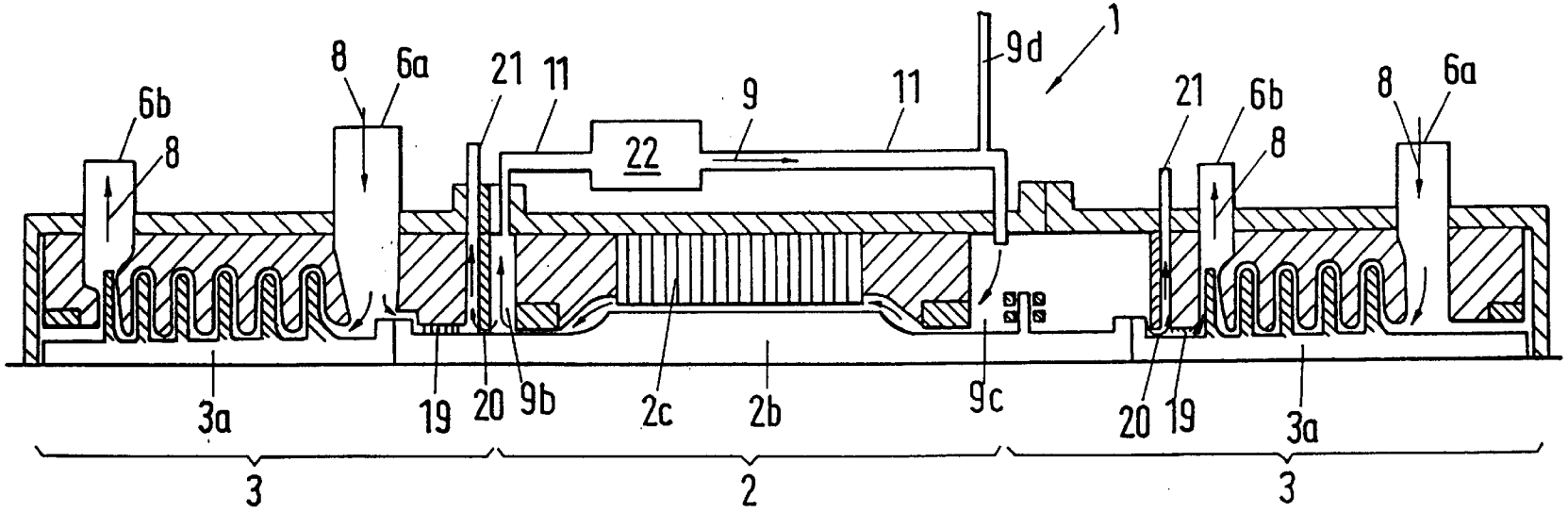
FIG. 7 is a longitudinal section of a turbocompressor with a separate cooling system.

FIG. 7 shows a turbocompressor 1 with a separately cooled electric motor 2 in comparison with the embodiment in accordance with FIG. 4. In this embodiment one system each having a double seal, comprising a dry gas seal 19 and a seal 20 after it, is arranged between the pressure part of the radial turbocompressor 3 and the electric motor 2, with an outlet 21 being arranged between the two seals 19, 20 which is designed as a vent (discharge to the atmosphere without gas combustion) or a flare (discharge to the atmosphere with gas combustion) and which extends through the housing 6. The electric motor 2 has a separate coolant circuit which is separated from the radial turbocompressor 3 by the seals 19, 20 and which comprises a connection line 11 and a cooler 22. The coolant gas mass flow 9 which cools the electric motor 2 flows between the stator 2*c* and the armature 2*b* in the longitudinal direction, is conducted near the one end (9*b*) of the electric motor 2 out of the housing 6 into the connection line 11 and is conducted after flowing through the cooler 22 and the following connection line 11 into the housing 6 at the other end 9*c* of the electric motor 2. Not illustrated are further components of this circulation, such as an apparatus which drives the coolant gas. An infeed line 9*d* supplies in additional coolant gas in order, for example, to compensate the coolant gas components which flow out via the output line 21. A non-aggressive gas such as nitrogen is suitable as a coolant gas. The arrangement in accordance with FIG. 7 is for example advantageous when no process gas is available at a low pressure level for cooling the electric motor 2 or when the process gas has aggressive properties or is contaminated, e.g. by liquid gas impurities, so that these could for example damage parts of the electric motor 2 such as the shaft 2*a* or the electrical insulation. The coolant circulation of the electric motor 2 can be designed in such a manner that the latter has a pressure in the range of the atmospheric pressure or slighty, above it. As illustrated in FIG. 7 the coolant circuit can be designed in such a manner that a low proportion of the coolant gas mass flow 9 arrives at the outlet 21 via the seal 20. Thereby, it remains ensured that the coolant gas mass flow 9 is not contaminated by foreign gases. In the exemplary embodiment in accordance with FIG. 7 a small proportion of the process gas 8 flows in addition via the seal 19 to the outlet 21. A so-called flair or vent can be placed after the outlet 21 in order to lead off the gases which emerge from the outlet 21 unburned (vent) or to lead them off via a following combustion (flare), in particular to the surroundings.

An advantage of the exemplary embodiment in accordance with FIG. 7 is to be seen in that the coolant gas mass flow 9 has a low pressure and/or that a gas which is favorable or can be handled without problem, in particular a gas without aggressive properties, can be used as a coolant gas.

An advantage of the turbocompressor 1 of the invention is to be seen in the fact that the electric motor 2 and the radial turbocompressor 3 can be pre-assembled together with the corresponding housing parts 6*e*, 6*f*, so that the turbocompressor 1 can be transported as a housing 6 or as a unit to the place of erection and can be erected there.

The lines 11, 12 which extend outside of the housing 6 in FIGS. 3, 4 and 7 and also the associated components 22 can also be arranged extending within the housing 6 in a further embodiment.

What is claimed is:

1. Turbocompressor comprising an outwardly gas-tight housing within which an electric motor and a multistage radial turbocompressor are arranged on a common shaft wherein, for the journalling of the shaft, electromagnetic radial bearings are arranged spaced apart in the direction of its extent and wherein a gas seal surrounding the shaft is arranged between the electric motor and the radial turbocompressor in order to seal off the electric motor with respect to the radial turbocompressor, the electric motor having an inner space which is connected in a fluid-conducting manner to an outlet opening which passes through the housing, end sections of the electric motor each having an inner space which is so connected in fluid-conducting manner via a connection line that a closed fluid circuit is formed via a gap of the electric motor formed between the stator and the rotor and the connection line, the closed fluid circuit being connected in fluid-conducting manner to a supply line in order to supply a separate fluid to the circuit.

2. Turbocompressor in accordance with claim 1 wherein the inner space surrounds the gap of the electric motor which is formed between the stator and the rotor.

3. Turbocompressor in accordance with claim 1 wherein a respective radial turbocompressor is arranged on both sides of the electric motor.

4. Turbocompressor in accordance with claim 1 wherein the inner space of one end section of the electric motor is fluid-conductingly connected to a compressor stage and the inner space of another end section is fluid-conductingly connected to the outlet opening.

5. Turbocompressor in accordance with claim 1 wherein the closed fluid circuit includes a cooler.

6. Turbocompressor in accordance with claim 1 including a seal arranged on the shaft between the inner space of the end section of the electric motor and the outlet opening.

7. Turbocompressor in accordance with claim 1 wherein the outlet opening opens into a flare or vent or is connected in a fluid-conducting manner to a suction side of a compressor.

8. Plant comprising a turbocompressor in accordance with claim 1.

9. Turbocompressor in accordance with claim 1 wherein the separate fluid comprises nitrogen.

* * * * *